US012104447B2

(12) United States Patent
Books et al.

(10) Patent No.: US 12,104,447 B2
(45) Date of Patent: Oct. 1, 2024

(54) TREE ORIENTATION SYSTEM AND METHOD FOR A RESOURCE EXTRACTION SYSTEM

(71) Applicant: ONESUBSEA IP UK LIMITED, London (GB)

(72) Inventors: Jacob Taylor Books, Houston, TX (US); David Russell June, Houston, TX (US); Erik Christian Wiest, Sugar Land, TX (US); Jonathan Mark Frankland, Leeds (GB)

(73) Assignee: ONESUBSEA IP UK LIMITED, London (GB)

( * ) Notice: Subject to any disclaimer, the term of this patent is extended or adjusted under 35 U.S.C. 154(b) by 15 days.

(21) Appl. No.: 18/248,014

(22) PCT Filed: Oct. 7, 2021

(86) PCT No.: PCT/US2021/053943

§ 371 (c)(1),
(2) Date: Apr. 5, 2023

(87) PCT Pub. No.: WO2022/076668

PCT Pub. Date: Apr. 14, 2022

(65) Prior Publication Data

US 2023/0374878 A1 Nov. 23, 2023

Related U.S. Application Data

(60) Provisional application No. 63/088,521, filed on Oct. 7, 2020.

(51) Int. Cl.
*E21B 33/035* (2006.01)
*E21B 19/00* (2006.01)
(Continued)

(52) U.S. Cl.
CPC ..... *E21B 33/035* (2013.01); *E21B 19/004* (2013.01); *E21B 33/0415* (2013.01); *E21B 33/043* (2013.01); *E21B 33/064* (2013.01)

(58) Field of Classification Search
CPC .. E21B 33/043; E21B 33/035; E21B 33/0415; E21B 33/064; E21B 19/004
See application file for complete search history.

(56) References Cited

U.S. PATENT DOCUMENTS 3,638,732 A * 2/1972 Huntsinger ..... E21B 17/023 166/368
4,077,472 A * 3/1978 Gano ..... E21B 33/043 166/359

(Continued)

FOREIGN PATENT DOCUMENTS

EP 3399139 A1 11/2018
WO 2016022029 A1 2/2016

OTHER PUBLICATIONS

Search Report and Written Opinion of International Patent Application No. PCT/US2021/053943 issued on Jan. 24, 2022; 9 pages.

(Continued)

*Primary Examiner* — Shane Bomar
(74) *Attorney, Agent, or Firm* — Jeffrey D. Frantz

(57) ABSTRACT

A method for aligning a tree within a resource extraction system includes disposing a riser system on a wellhead of the resource extraction system without utilizing a mechanical alignment system to circumferentially align the riser system with the wellhead. The method also includes disposing a tubing hanger at a landed position within the wellhead. In addition, the method includes disposing an orientation mechanism on the wellhead. The orientation mechanism includes an alignment feature configured to engage a corresponding alignment feature of the tree. Furthermore, the method includes moving the tree toward the wellhead such (Continued)

that the alignment feature of the tree engages the alignment feature of the orientation mechanism to approximately establish a target circumferential orientation of the tree relative to the tubing hanger.

20 Claims, 6 Drawing Sheets

(51) Int. Cl.
*E21B 33/04* (2006.01)
*E21B 33/043* (2006.01)
*E21B 33/064* (2006.01)

(56) References Cited

U.S. PATENT DOCUMENTS 4,286,665 A * 9/1981 Walker ..... E21B 41/08 175/7
9,376,872 B2 6/2016 June
2003/0146000 A1 8/2003 Dezen et al.
2010/0224373 A1 9/2010 Williams
2014/0054044 A1* 2/2014 Nellessen, Jr. ..... E21B 23/01 166/341
2015/0259990 A1 9/2015 June
2018/0320469 A1 11/2018 June
2019/0120008 A1* 4/2019 DeBerry ..... E21B 33/04
2020/0217165 A1* 7/2020 Robottom ..... E21B 33/04
2020/0399973 A1* 12/2020 Mitchell ..... E21B 33/0407
2023/0112502 A1* 4/2023 Books ..... E21B 23/006 166/75.14
2024/0209711 A1* 6/2024 DeBerry ..... E21B 33/04

OTHER PUBLICATIONS

International Preliminary Report on Patentability of International Patent Application No. PCT/US2021/053943 issued on Apr. 20, 2023, 6 pages.

* cited by examiner

TREE ORIENTATION SYSTEM AND METHOD FOR A RESOURCE EXTRACTION SYSTEM

CROSS REFERENCE TO RELATED APPLICATION

This application is an National Stage Entry of International Application No. PCT/US2021/053943, filed Oct. 7, 2021, which claims priority from and the benefit of U.S. Provisional Application Ser. No. 63/088,521, entitled "Subsea Tree Orientation Method and System for Satellite Wells," filed Oct. 7, 2020, which is hereby incorporated by reference in its entirety.

BACKGROUND

The present disclosure relates generally to a tree orientation system and method for a resource extraction system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Fluids (e.g., hydrocarbons) may be extracted from subsurface reservoirs and transported to the surface for commercial sales, such as for use in the power industry, transportation industry, manufacturing industry, and other applicable industries. For example, a well may be drilled into the ground to a subsurface reservoir, and equipment may be installed in the well and on the surface to facilitate extraction of the fluids. In some cases, the wells may be offshore (e.g., subsea), and the equipment may be disposed underwater, on offshore platforms, and/or on floating systems.

In some drilling and production systems, a hanger, such as a tubing hanger, may be used to suspend a string (e.g., piping for a flow in and/or out of the well). Such a hanger may be disposed within a wellhead, which supports both the hanger and the string. For example, a tubing hanger may be lowered into a wellhead of a wellhead system by a landing string. During the running or lowering process, the tubing hanger may be coupled to the landing string by a tubing hanger running tool (THRT). Once the tubing hanger has been lowered into a landed position within the wellhead, the tubing hanger may be permanently locked into position. The THRT may then be uncoupled from the tubing hanger and extracted from the wellhead system by the landing string.

During the tubing hanger landing process, the tubing hanger may be rotated to approximately the target orientation (e.g., within 90 degrees of the target orientation). The tubing hanger may then be temporarily landed within the wellhead, and an extendable element of a blowout preventer (BOP) may be extended to engage a clearance within the THRT. Next, the THRT/tubing hanger may be raised. Contact between the extendable element and a camming surface of the THRT may drive the tubing hanger to a target circumferential orientation as the THRT/tubing hanger is raised. When the tubing hanger reaches the target circumferential orientation, the extendable element engages a slot in the THRT. As the tubing hanger is subsequently lowered to the final landed position, engagement of the extendable element with the slot maintains the tubing hanger in the target circumferential orientation, thereby locating each flow passage of the tubing hanger in a target circumferential position within the wellhead. As previously discussed, once the tubing hanger is landed, the THRT may be uncoupled from the tubing hanger and extracted from the wellhead system.

The BOP may include a mechanical alignment feature configured to engage a corresponding mechanical alignment feature of the wellhead to precisely circumferentially orient the BOP relative to the wellhead. The mechanical alignment feature of the BOP and the extendable element are precisely calibrated (e.g., jigged) to one another before the BOP is transported to the location of the wellhead. Unfortunately, the calibration (e.g., jigging) process is time-consuming and costly. For example, the BOP may experience significant downtime during the calibration process and expensive calibration equipment, such as a calibration tubing hanger and a calibration wellhead, may be used during the calibration process.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain embodiments, a method for aligning a tree within a resource extraction system includes disposing a riser system on a wellhead of the resource extraction system without utilizing a mechanical alignment system to circumferentially align the riser system with the wellhead. The method also includes disposing a tubing hanger at a landed position within the wellhead. In addition, the method includes removing the riser system from the wellhead and disposing an orientation mechanism on the wellhead. The orientation mechanism includes a first alignment feature configured to engage a first corresponding alignment feature of the tree, and a second alignment feature of an orientation mechanism running tool engages a second corresponding alignment feature of the tubing hanger as the orientation mechanism is disposed on the wellhead to establish a first target circumferential orientation of the orientation mechanism relative to the tubing hanger. Furthermore, the method includes moving the tree toward the wellhead such that the first corresponding alignment feature of the tree engages the first alignment feature of the orientation mechanism to approximately establish a second target circumferential orientation of the tree relative to the tubing hanger. The method also includes disposing the tree on the wellhead such that a third alignment feature of the tree engages the second corresponding alignment feature of the tubing hanger to precisely establish the second target circumferential orientation of the tree relative to the tubing hanger.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
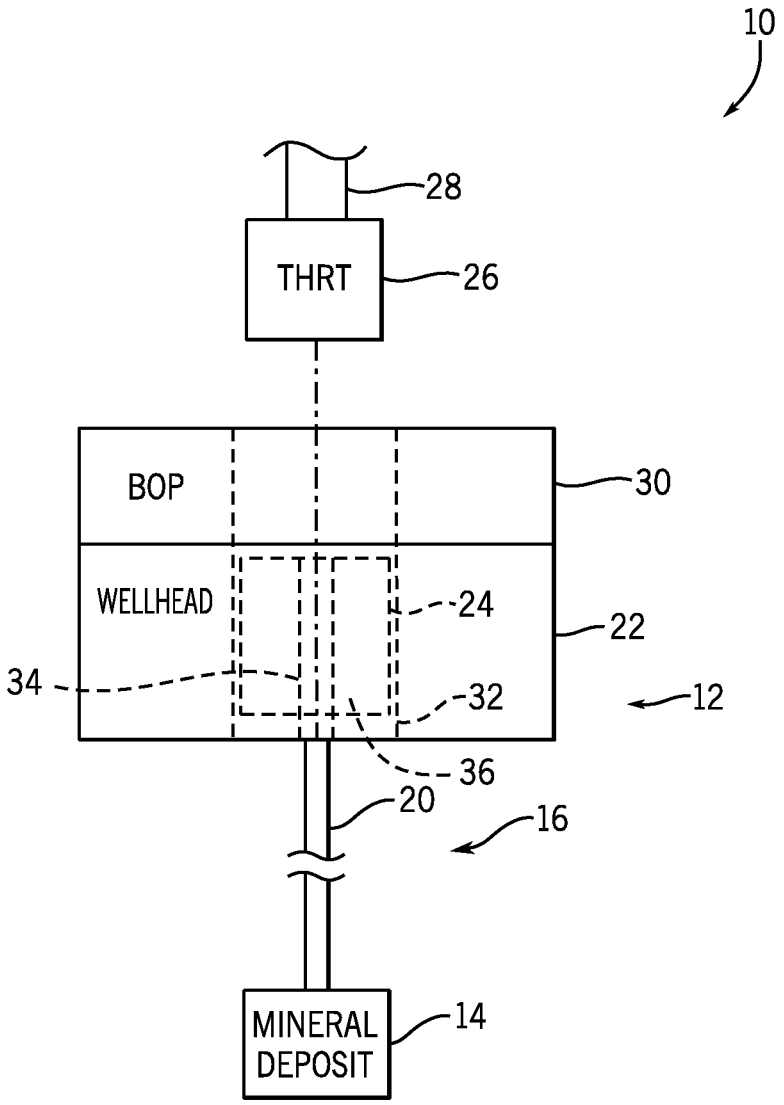
FIG. 1 is a block diagram of an embodiment of a resource extraction system.

Specific embodiments of the present disclosure are described below. To provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

As explained above, a blowout preventer (BOP) may include a mechanical alignment feature configured to engage a corresponding mechanical alignment feature of a wellhead to precisely circumferentially orient the BOP relative to the wellhead. The mechanical alignment feature of the BOP and the extendable element, which is used to orient the tubing hanger at the target circumferential orientation, are precisely calibrated (e.g., jigged) to one another before the BOP is transported to the location of the wellhead. Unfortunately, the calibration (e.g., jigging) process is time-consuming and costly. For example, the BOP may experience significant downtime during the calibration process and expensive calibration equipment, such as a calibration tubing hanger and a calibration wellhead, may be used during the calibration process.

In certain embodiments disclosed herein, a method for aligning the tree within the resource extraction system may be employed that substantially reduces the cost of a wellhead system of the resource extraction system. In certain embodiments, a riser system (e.g., including a BOP, an orientation spool, etc.) may be disposed on a wellhead of the resource extraction system. A tubing hanger may then be disposed at a landed position within the wellhead. Next, the riser system may be removed from the wellhead. An orientation mechanism may then be disposed on the wellhead. The orientation mechanism includes a first alignment feature configured to engage a first corresponding alignment feature of the tree. In addition, a second alignment feature of an orientation mechanism running tool engages a second corresponding alignment feature of the tubing hanger as the orientation mechanism is disposed on the wellhead to establish a first target circumferential orientation of the orientation mechanism relative to the tubing hanger. In certain embodiments, the orientation mechanism includes a flowline positioning system configured to position an inlet of a flowline at a target circumferential position based on the first target circumferential orientation of the orientation mechanism. Next, the tree may be moved toward the wellhead such that the first corresponding alignment feature of the tree engages the first alignment feature of the orientation mechanism to approximately establish a second target circumferential orientation of the tree relative to the tubing hanger. The tree may then be disposed on the wellhead such that a third alignment feature of the tree engages the second corresponding alignment feature of the tubing hanger to precisely establish the second target circumferential orientation of the tree relative to the tubing hanger. An outlet of the tree is positioned precisely at the target circumferential position while the tree is precisely oriented at the second target circumferential orientation. Accordingly, in embodiments in which the orientation mechanism includes the flowline positioning system, the outlet of the tree is precisely circumferentially aligned with the inlet of the flowline. In certain embodiments, the riser system is disposed on the wellhead without utilizing a mechanical alignment system to circumferentially align the riser system with the wellhead. As a result, the cost of the wellhead system may be substantially reduced (e.g., as compared to a BOP that includes a mechanical alignment feature that is precisely calibrated for the wellhead during the manufacturing process).

FIG. 1 is a block diagram of an embodiment of a resource extraction system 10. The resource extraction system 10 may be configured to extract various minerals and natural resources, including hydrocarbons (e.g., oil and/or natural gas) from the earth, or the resource extraction system may be configured to inject substances into the earth. In some embodiments, the resource extraction system 10 is land-based (e.g., a surface system) or subsea (e.g., a subsea system). As illustrated, the resource extraction system 10 includes a wellhead system 12 coupled to a mineral deposit 14 via a well 16 having a wellbore 20.

In the illustrated embodiment, the wellhead system 12 includes a wellhead 22 and a tubing hanger 24. The resource extraction system 10 may include other device(s) that are coupled to the wellhead system 12 and/or device(s) that are used to assemble various components of the wellhead system 12. For example, in the illustrated embodiment, the resource extraction system 10 includes a tubing hanger running tool (THRT) 26 suspended from a landing string 28.

In certain embodiments, the tubing hanger 24 supports tubing (e.g., a tubing string). During a running or lowering process, the THRT 26 is non-rotatably coupled to the tubing hanger 24, thereby coupling the tubing hanger 24 to the landing string 28. The THRT 26, which is coupled to the tubing hanger 24, is lowered (e.g., run) from an offshore vessel to the wellhead system 12. Once the tubing hanger 24 is lowered into a landed position within the wellhead 22, the tubing hanger 24 may be permanently locked into position. The THRT 26 may then be uncoupled from the tubing hanger 24 and extracted from the wellhead system 12 by the landing string 28, as illustrated.

In the illustrated embodiment, the wellhead system 12 includes a blowout preventer (BOP) 30. The BOP 30 may include a variety of valves, fittings, and controls to block oil, gas, or other fluid from exiting the well in the event of an unintentional release of pressure or an overpressure condition. Furthermore, the wellhead 22 has a bore 32, which may provide access to the wellbore 20 for various completion and workover procedures. For example, components may be run down to the wellhead system 12 and disposed in the wellhead bore 32 to seal-off the wellbore 20, to inject chemicals downhole, to suspend tools downhole, to retrieve tools, and the like.

The wellbore 20 may contain elevated fluid pressures. For example, pressures within the wellbore 20 may exceed 10,000 pounds per square inch (PSI), 15,000 PSI, or 20,000 PSI. Accordingly, the resource extraction system 10 may employ various mechanisms, such as mandrels, seals, plugs, and valves, to control the well 16. For example, the illustrated tubing hanger 24 may be disposed within the wellhead 22 to secure tubing suspended in the wellbore 20, and to provide a path for hydraulic control fluid, chemical injection, electrical connection(s), fiber optic connection(s), and the like. The tubing hanger 24 includes a central bore 34 that extends through the center of a body 36 of the tubing hanger 24, and that is in fluid communication with the wellbore 20. The central bore 34 is configured to facilitate flow of hydrocarbons through the body 36 of the tubing hanger 24.

As discussed in detail below, the BOP 30 may be removed from the wellhead 22, and a tree may be disposed on the wellhead 22. In certain embodiments, the method of disposing the tree on the wellhead 22 includes disposing the BOP 30 on the wellhead 22 of the resource extraction system 10 and disposing the tubing hanger 24 at a landed position within the wellhead 22. Next, the BOP 30 is removed from the wellhead 22, and an orientation mechanism is disposed on the wellhead 22. The orientation mechanism includes a first alignment feature configured to engage a first corresponding alignment feature of the tree. In certain embodiments, the process of disposing the orientation mechanism on the wellhead 22 includes moving the orientation mechanism toward the wellhead using an orientation mechanism running tool, engaging a second alignment feature of the orientation mechanism running tool with a second corresponding alignment feature of the tubing hanger 24 as the orientation mechanism is disposed on the wellhead 22 to establish a first target circumferential orientation of the orientation mechanism relative to the tubing hanger 24, and removing the orientation mechanism running tool. The tree is then moved toward the wellhead 22 such that the first corresponding alignment feature of the tree engages the first alignment feature of the orientation mechanism to approximately establish a second target circumferential orientation of the tree relative to the tubing hanger 24. Next, the tree is disposed on the wellhead such that a third alignment feature of the tree engages the second corresponding alignment feature of the tubing hanger to precisely establish the second target circumferential orientation of the tree relative to the tubing hanger 24.

Figure 2:
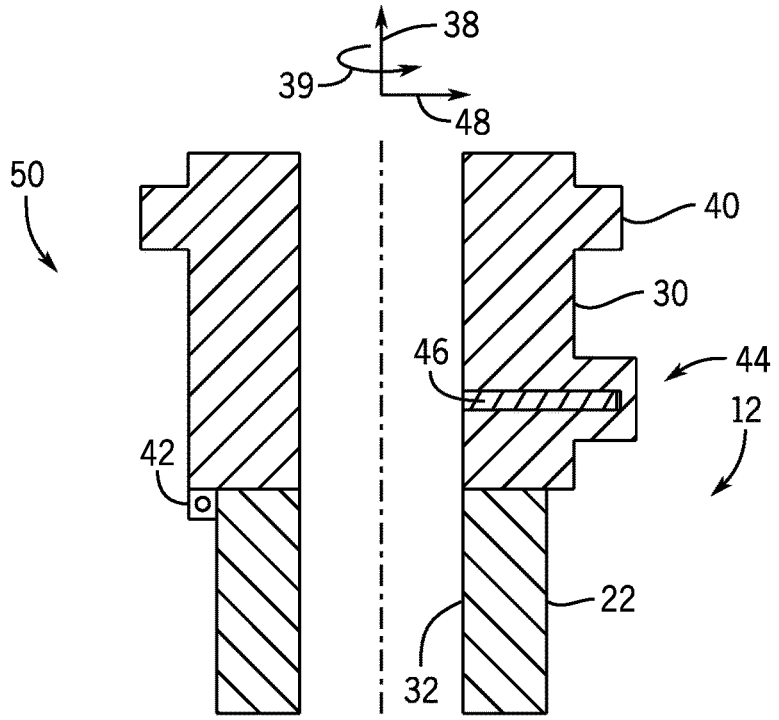
FIG. 2 is a cross-sectional view of an embodiment of a wellhead system that may be employed within the resource extraction system of FIG. 1, in which a blowout preventer is disposed on a wellhead.

FIG. 2 is a cross-sectional view of an embodiment of a wellhead system 12 that may be employed within the resource extraction system of FIG. 1. As illustrated, the BOP 30 is disposed on the wellhead 22. The BOP 30 may be disposed on the wellhead 22 by moving (e.g., lowering) the BOP 30 toward the wellhead 22 along a longitudinal axis 38 until the BOP 30 engages the wellhead 22. In certain embodiments, the BOP 30 is disposed on the wellhead 22 without utilizing a mechanical alignment system to circumferentially align the BOP 30 with the wellhead 22. As a result, the cost of the wellhead system may be substantially reduced (e.g., as compared to a BOP that includes a mechanical alignment system that is precisely calibrated for the wellhead during the manufacturing process). As used herein, "mechanical alignment system" includes any suitable device(s) configured to physically circumferentially align the BOP with the wellhead as the BOP is disposed on the wellhead via mechanical interaction between the device(s), between the device(s) and the BOP, between the device(s) and the wellhead, or a combination thereof.

In certain embodiments, the BOP 30 is circumferentially aligned with the wellhead 22 (e.g., aligned along a circumferential axis 39) via visual alignment. For example, the BOP 30 may include a visual indicator 40 (e.g., a component of the BOP, a mark, such as an arrow, painted on the BOP, a mark, such as an arrow, mounted to the BOP, a mark, such as an arrow, formed on a surface of the BOP via a casting process, another suitable visual indicator, or a combination thereof). The visual indicator 40 may be used as a visual guide while disposing the BOP 30 on the wellhead 22, thereby enabling an operator to rotate the BOP 30 to a desired circumferential orientation (e.g., desired orientation along the circumferential axis 39). Additionally, or alternatively, an optical alignment system 42 may be used to circumferentially align the BOP with the wellhead. The optical alignment system 42 may include any suitable optical device(s) configured to facilitate alignment of the BOP with the wellhead, such as one or more cameras, one or more lights, one or more lasers, one or more light detectors, other suitable optical device(s), or a combination thereof. The optical alignment system 42 may enable an operator or an automated system to rotate the BOP until the BOP is oriented at a desired circumferential orientation (e.g., based on feedback from the camera(s), light detector(s), etc.). While circumferentially aligning the BOP via visual alignment and/or the optical alignment system is disclosed above, in certain embodiments, the BOP may be aligned with the wellhead using any other suitable non-mechanical alignment system (e.g., alone or in combination with the visual alignment and/or the optical alignment system), such as an alignment system that uses acoustic/ultrasonic sensor(s), an alignment system that uses inductive sensor(s), another suitable type of non-mechanical alignment system, or a combination thereof. Because non-mechanical alignment may not be as accurate as mechanical alignment, non-mechanical alignment techniques/systems may be utilized for applications in which precise orientation of the BOP (e.g., and the subsequently attached tree) relative to the wellhead 22 is not specified (e.g., for satellite well applications, etc.). While disposing the BOP 30 on the wellhead 22 without utilizing a mechanical alignment system to circumferentially align the BOP 30 with the wellhead 22 is disclosed above, in certain embodiments, the wellhead system may include a mechanical alignment system configured to mechanically align the BOP with the wellhead (e.g., orient the BOP precisely at a desired circumferential orientation relative to the wellhead).

As discussed in detail below, the wellhead system 12 includes an alignment system 44 configured to drive a tubing hanger to rotate to a target circumferential orientation (e.g., third target circumferential orientation) relative to the BOP 30 (e.g., in response to longitudinal movement of the tubing hanger). In the illustrated embodiment, the alignment system 44 includes a protrusion 46 movably coupled to the BOP 30. As discussed in detail below, the protrusion 46 is extendable from the illustrated retracted position to an extended position along a radial axis 48, and the protrusion 46 is configured to engage a cam surface formed on a tubing hanger running tool while the protrusion is extended. Contact between the protrusion 46 and the cam surface of the tubing hanger running tool drives the tubing hanger to rotate to the target circumferential orientation (e.g., target orientation along the circumferential axis 39) in response to longitudinal movement of the tubing hanger.

In the illustrated embodiment, the BOP 30 is an element of a riser system 50. In certain embodiments, the riser system 50 also includes a tubing hanger orientation spool. In such embodiments, the tubing hanger orientation spool may include the protrusion configured to engage the cam surface of the tubing hanger running tool to drive the tubing hanger to rotate to the target circumferential orientation in response to longitudinal movement of the tubing hanger. Furthermore, in certain embodiments, the BOP may be omitted from the riser system, and/or the riser system may include other suitable component(s) (e.g., alone or in combination with the BOP and/or the tubing hanger orientation spool).

Figure 3:
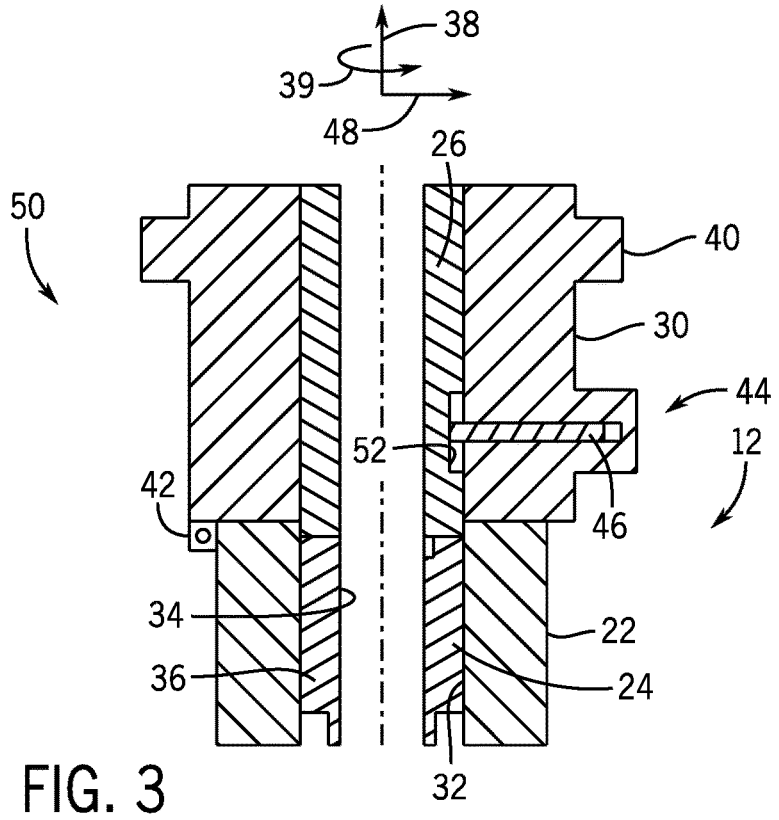
FIG. 3 is a cross-sectional view of the wellhead system of FIG. 2, in which a tubing hanger is disposed within the wellhead of the wellhead system.

FIG. 3 is a cross-sectional view of the wellhead system 12 of FIG. 2, in which a tubing hanger 24 is disposed within the wellhead 22 of the wellhead system 12. As illustrated, the tubing hanger 24 is disposed at a landed position within the wellhead 22. As previously discussed, during a running/lowering process, the tubing hanger 24 is non-rotatably coupled to the THRT 26, thereby coupling the tubing hanger to the landing string. The landing string lowers (e.g., runs) the THRT 26 and the tubing hanger 24 to the wellhead assembly 12 along the longitudinal axis 38. Once the tubing hanger 24 is lowered into the illustrated landed position within the wellhead 22, the tubing hanger 24 may be permanently locked into position. The THRT 26 may then be uncoupled from the tubing hanger 24 and extracted from the wellhead system 12 by the landing string.

As previously discussed, the alignment assembly 44 drives the tubing hanger 24 to rotate to a target circumferential orientation (e.g., first circumferential orientation) relative to the BOP 30/riser system 50 as the tubing hanger 24 moves along the longitudinal axis 38. In the illustrated embodiment, the alignment assembly 44 includes the protrusion 46 and a cam surface 52 formed on the THRT 26. Contact between the protrusion 46 and the cam surface 52 drives the tubing hanger 24 to rotate to the target circumferential orientation as the tubing hanger 24 moves along the longitudinal axis 38 (e.g., in upward and/or downward direction(s)). For example, the protrusion 46 may be retracted during the tubing hanger landing process until the protrusion 46 is aligned with a first end (e.g., lower end or upper end) of the cam surface 52. The protrusion 46 may then be extended to engage the cam surface 52. Interaction between the protrusion 46 and the cam surface 52 drives the tubing hanger 24 to rotate along the circumferential axis 39 in response to movement (e.g., downward movement or upward movement) of the tubing hanger 24 along the longitudinal axis 38. As a result, the tubing hanger 24 may be oriented precisely at the target circumferential orientation relative to the BOP/riser system while the tubing hanger 24 is disposed within the wellhead 22 at the illustrated landed position. The protrusion 46 may then be retracted to facilitate extraction of the THRT 26 from the wellhead assembly 12.

While the cam surface 52 is formed on the THRT 26 in the illustrated embodiment, in other embodiments, the cam surface may be formed on the tubing hanger or the landing string. Furthermore, while the protrusion 46 is movably coupled to the BOP 30 in the illustrated embodiment, in other embodiments, the protrusion may be movably coupled to another element of the riser system, such as a tubing hanger orientation spool. In addition, in certain embodiments, the protrusion may be movably coupled to the tubing hanger, the tubing hanger running tool, or the landing string. In such embodiments, the cam surface may be formed on the riser system (e.g., on the BOP, on a tubing hanger orientation spool, etc.). While the alignment system 44 includes the protrusion 46 and the cam surface 52 in the illustrated embodiment, in other embodiments, the alignment system may include any other suitable component(s) configured to mechanically drive the tubing hanger to rotate to the target circumferential orientation relative to the BOP/riser system in response to longitudinal movement of the tubing hanger. Furthermore, in certain embodiments, the alignment system may not be used to drive the tubing hanger to rotate to the target circumferential orientation relative to the BOP/riser system. In such embodiments, the tubing hanger may be lowered (e.g., run) to the landed position without regard to the circumferential orientation of the tubing hanger relative to the BOP/riser system, or the tubing hanger may be rotated to the target circumferential orientation (e.g., approximately the target circumferential orientation or precisely the target circumferential orientation) by circumferentially orienting the landing string. In addition, in such embodiments, at least a portion of the alignment system may be omitted (e.g., each element of the alignment system may be omitted). As discussed in detail below, the orientation mechanism may be used to approximately establish a target circumferential orientation of the tree relative to the tubing hanger without regard to the circumferential orientation of the tubing hanger relative to the wellhead.

As previously discussed, after the tubing hanger 24 is disposed within the wellhead 22 at the illustrated landed position, the tubing hanger 24 may be coupled to the wellhead 22, thereby locking the tubing hanger in the landed position. The THRT 26 may then be extracted from the wellhead assembly 12 via the landing string. The BOP 30/riser system 50 may then be removed from the wellhead 22.

Figure 4:
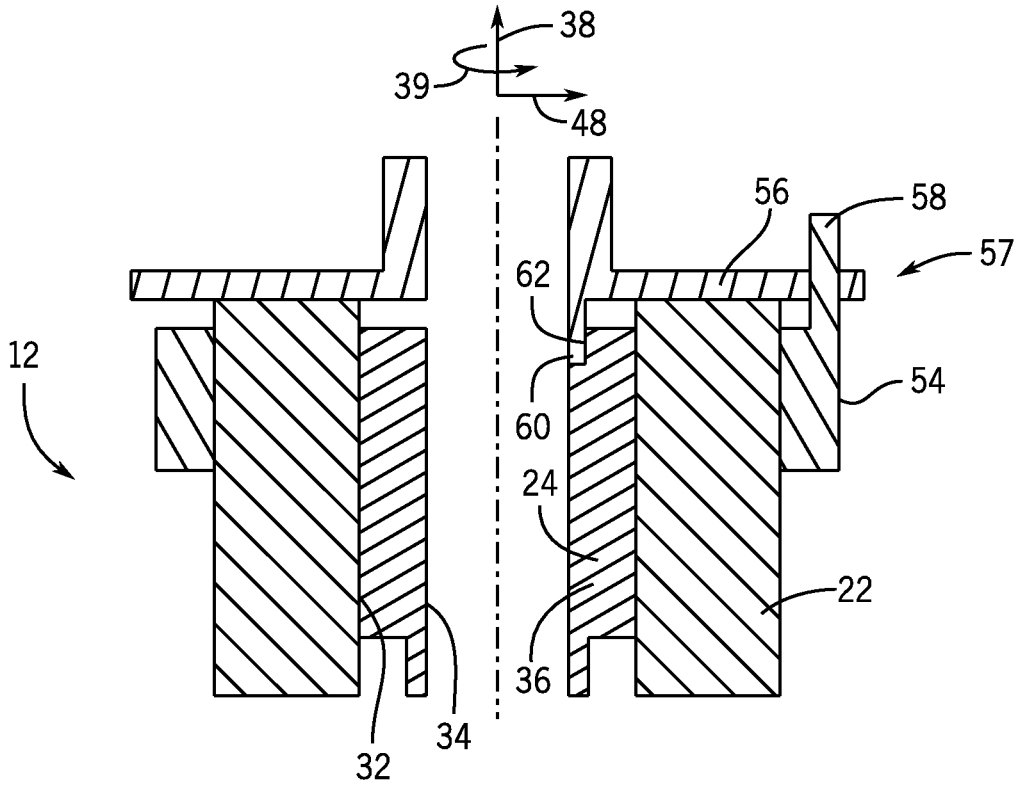
FIG. 4 is a cross-sectional view of the wellhead system of FIG. 3, in which the blowout preventer is removed from the wellhead, an embodiment of an orientation mechanism is disposed on the wellhead, and an embodiment of an orientation mechanism running tool is coupled to the orientation mechanism.

FIG. 4 is a cross-sectional view of the wellhead system 12 of FIG. 3, in which the BOP/riser system is removed from the wellhead 22, an embodiment of an orientation mechanism 54 is disposed on the wellhead 22, and an embodiment of an orientation mechanism running tool 56 is coupled to the orientation mechanism 54. The orientation mechanism 54 and the orientation mechanism running tool 56 are elements of an orientation system 57. After the BOP/riser system is removed from the wellhead 22, the orientation mechanism 54 may be disposed on the wellhead 22, as illustrated. In the illustrated embodiment, the orientation mechanism 54 is lowered (e.g., run) to the wellhead 22 along the longitudinal axis 38 using the orientation mechanism running tool 56. The orientation mechanism running tool 56 is non-rotatably coupled to the orientation mechanism 54 and supports the orientation mechanism 54 during the lowering (e.g., running) process. For example, the landing string may be coupled to the orientation mechanism running tool 56 and used to lower (e.g., run) the orientation mechanism 54 to the wellhead 22.

In the illustrated embodiment, the orientation mechanism 54 includes an alignment feature 58 (e.g., first alignment feature, second alignment feature) configured to engage a corresponding alignment feature (e.g., first corresponding alignment feature, second corresponding alignment feature) of the tree. In addition, an alignment feature 60 (e.g., first alignment feature, second alignment feature) of the orientation mechanism running tool 56 engages a corresponding alignment feature 62 (e.g., first corresponding alignment feature, second corresponding alignment feature) of the tubing hanger 24 as the orientation mechanism 54 is disposed on the wellhead 22, thereby establishing a target circumferential orientation (e.g., first target circumferential orientation) of the orientation mechanism 54 relative to the tubing hanger 24. The orientation mechanism running tool 56 is circumferentially non-rotatably coupled to the orientation mechanism 54 via the alignment feature 58 to establish a desired circumferential offset (e.g., 0 degrees, 10 degrees, 20 degrees, etc.) between the alignment feature 58 of the orientation mechanism 54 and the alignment feature 60 of the orientation mechanism running tool 56. Accordingly, engaging the alignment feature 60 of the orientation mechanism running tool 56 with the corresponding alignment feature 62 of the tubing hanger 24 positions (e.g., precisely positions) the alignment feature 58 of the orientation mechanism 54 at a target circumferential position (e.g., position along the circumferential axis 39). As a result, a desired offset between the corresponding alignment feature 62 of the tubing hanger 24 and the alignment feature 58 of the orientation mechanism 54 is established.

To engage the alignment feature 60 of the orientation mechanism running tool 56 with the corresponding alignment feature 62 of the tubing hanger 24, the orientation mechanism running tool 56 may be rotated along the circumferential axis 39 until the alignment feature 60 of the orientation mechanism running tool 56 engages the corresponding alignment feature 62 of the tubing hanger 24 (e.g., in response to circumferential alignment of the alignment features). In certain embodiments, a bearing may be disposed between the orientation mechanism running tool and the wellhead (e.g., coupled to the orientation mechanism running tool) to facilitate rotation of the orientation mechanism running tool along the circumferential axis relative to the wellhead. In the illustrated embodiment, the alignment feature 60 of the orientation mechanism running tool 56 includes a longitudinal protrusion, and the corresponding alignment feature 62 of the tubing hanger 24 includes a corresponding longitudinal recess. However, in other embodiments, the alignment feature of the orientation mechanism running tool and the corresponding alignment feature of the tubing hanger may include other suitable type(s) of alignment feature(s). For example, in certain embodiments, the alignment feature of the orientation mechanism running tool may include one or more recesses, and the corresponding alignment feature of the tubing hanger may include corresponding protrusion(s). Furthermore, in certain embodiments, the alignment feature of the orientation mechanism running tool may include one or more radial pins, and the corresponding alignment feature of the tubing hanger may include corresponding radial groove (s) (e.g., within a longitudinal end of the tubing hanger) configured to receive the radial pin(s). Once the alignment feature of the orientation mechanism running tool is engaged with the corresponding alignment feature of the tubing hanger, rotation of the orientation mechanism relative to the tubing hanger along the circumferential axis is blocked.

The orientation mechanism 54 is circumferentially non-rotatably coupled to the wellhead 22 (e.g., as the orientation mechanism is being disposed on the wellhead or after the orientation mechanism is disposed on the wellhead). For example, in certain embodiments, the orientation mechanism may include one or more protrusions (e.g., retractable protrusion(s)) configured to engage corresponding recess(es) of the wellhead to block rotation of the orientation mechanism relative to the wellhead along the circumferential axis. Additionally, or alternatively, the orientation mechanism may include one or more recesses configured to engage corresponding protrusion(s) (e.g., retractable protrusion(s)) of the wellhead. Furthermore, in certain embodiments, a locking ring (e.g., disposed about the orientation mechanism) may circumferentially non-rotatably couple the orientation mechanism to the wellhead (e.g., alone or in combination with the recess(es)/protrusion(s)). While recess(es)/protrusion(s) and a locking ring are disclosed above, other suitable type(s) of locking device(s) may be used (e.g., alone or in combination with the recess(es)/protrusion(s) and/or the locking ring) to circumferentially non-rotatably couple the orientation mechanism to the wellhead. In addition, in certain embodiments, one or more radial pads may be disposed between the orientation mechanism and the wellhead. Furthermore, any suitable device(s) may be utilized to block movement of the orientation mechanism 54 relative to the wellhead 22 along the longitudinal axis 38 (e.g., one or more protrusions configured to engage corresponding recess(es), one or more engagement surfaces, etc.).

Figure 5:
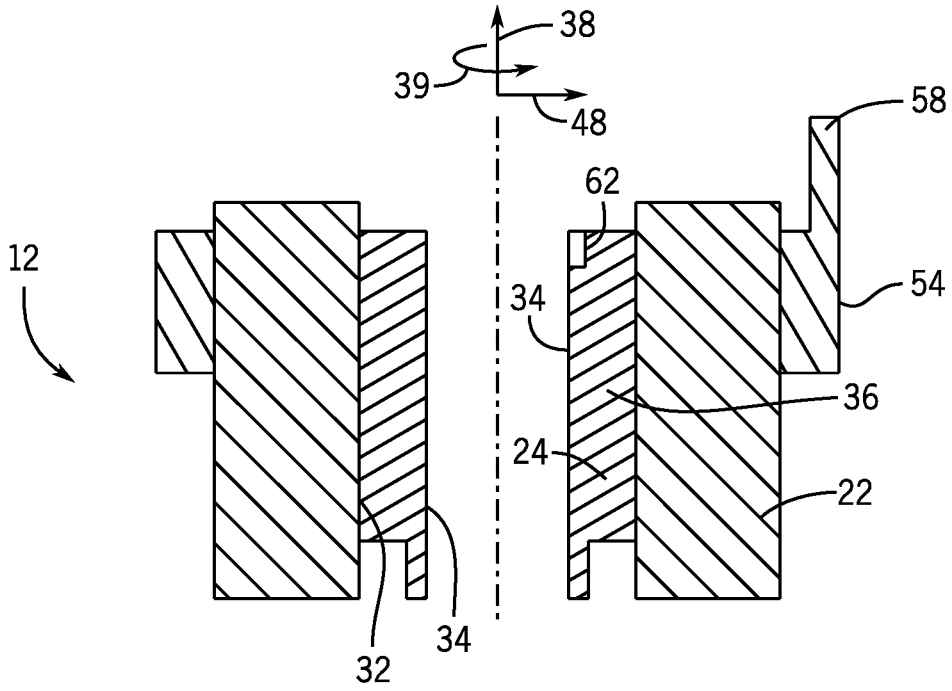
FIG. 5 is a cross-sectional view of the wellhead system of FIG. 4, in which the orientation mechanism running tool is removed.

FIG. 5 is a cross-sectional view of the wellhead system 12 of FIG. 4, in which the orientation mechanism running tool is removed. As illustrated, with the orientation mechanism running tool removed, the alignment feature 58 of the orientation mechanism 54 is available to engage the corresponding alignment feature of the tree. In addition, the corresponding alignment feature 62 of the tubing hanger 24 is available to engage another alignment feature of the tree.

Figure 6:
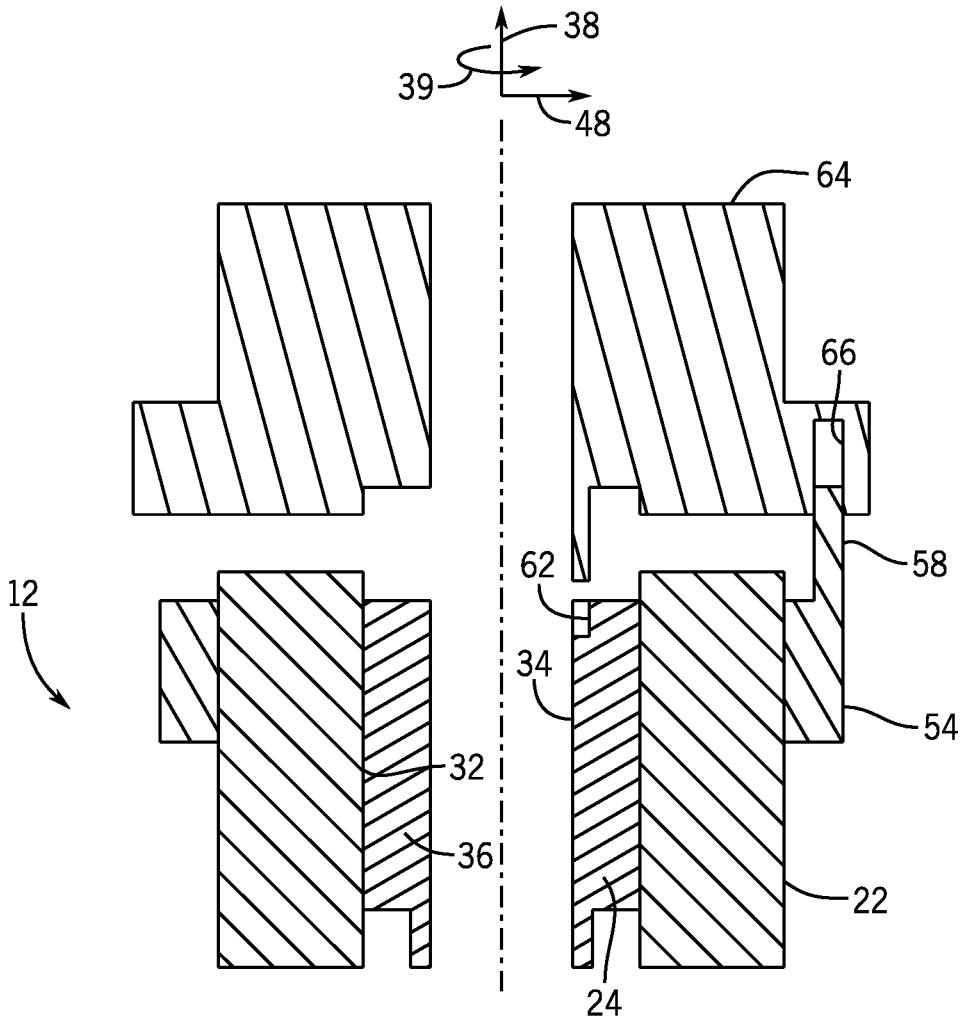
FIG. 6 is a cross-sectional view of the wellhead system of FIG. 5, in which a tree is engaged with the orientation mechanism.

FIG. 6 is a cross-sectional view of the wellhead system 12 of FIG. 5, in which a tree 64 is engaged with the orientation mechanism 54. The tree 64 is moved toward the wellhead such that the alignment feature 58 of the orientation mechanism 54 engages the corresponding alignment feature 66 (e.g., first corresponding alignment feature, second corresponding alignment feature) of the tree 64, thereby approximately establishing a target circumferential orientation (e.g., second target circumferential orientation) of the tree 64 relative to the tubing hanger 24. As previously discussed, a desired circumferential offset between the corresponding alignment feature 62 of the tubing hanger 24 and the alignment feature 58 of the orientation mechanism 54 is established using the orientation mechanism running tool. Accordingly, engaging the alignment feature 58 of the orientation mechanism 54 with the corresponding alignment feature 66 of the tree 64 approximately establishes a target circumferential orientation of the tree 64 relative to the tubing hanger 24.

In the illustrated embodiment, the alignment feature 58 of the orientation mechanism 54 includes a longitudinal protrusion, and the corresponding alignment feature 66 of the tree includes a corresponding longitudinal recess. In certain embodiments, the circumferential extent of the longitudinal recess is greater than the circumferential extent of the longitudinal protrusion. Accordingly, an amount of circumferential rotation of the tree relative to the orientation mechanism, wellhead, and tubing hanger is enabled. While the alignment feature of the orientation mechanism includes a longitudinal protrusion and the corresponding alignment feature of the tree includes a corresponding longitudinal recess in the illustrated embodiment, in other embodiments, the alignment feature of the orientation mechanism and the corresponding alignment feature of the tree may include other suitable type(s) of alignment feature(s). For example, in certain embodiments, the alignment feature of the orientation mechanism may include one or more recesses, and the corresponding alignment feature of the tree may include corresponding protrusion(s). Furthermore, in certain embodiments, the alignment feature of the orientation mechanism may include one or more radial pins, and the corresponding alignment feature of the tree may include corresponding radial groove(s) (e.g., within a longitudinal end of the tree) configured to receive the radial pin(s). In addition, while the orientation mechanism includes one orientation feature for both the orientation mechanism running tool and the tree in the illustrated embodiment, in other embodiments, the orientation mechanism may include one orientation feature for the orientation mechanism running tool and another orientation feature for the tree.

Figure 7:
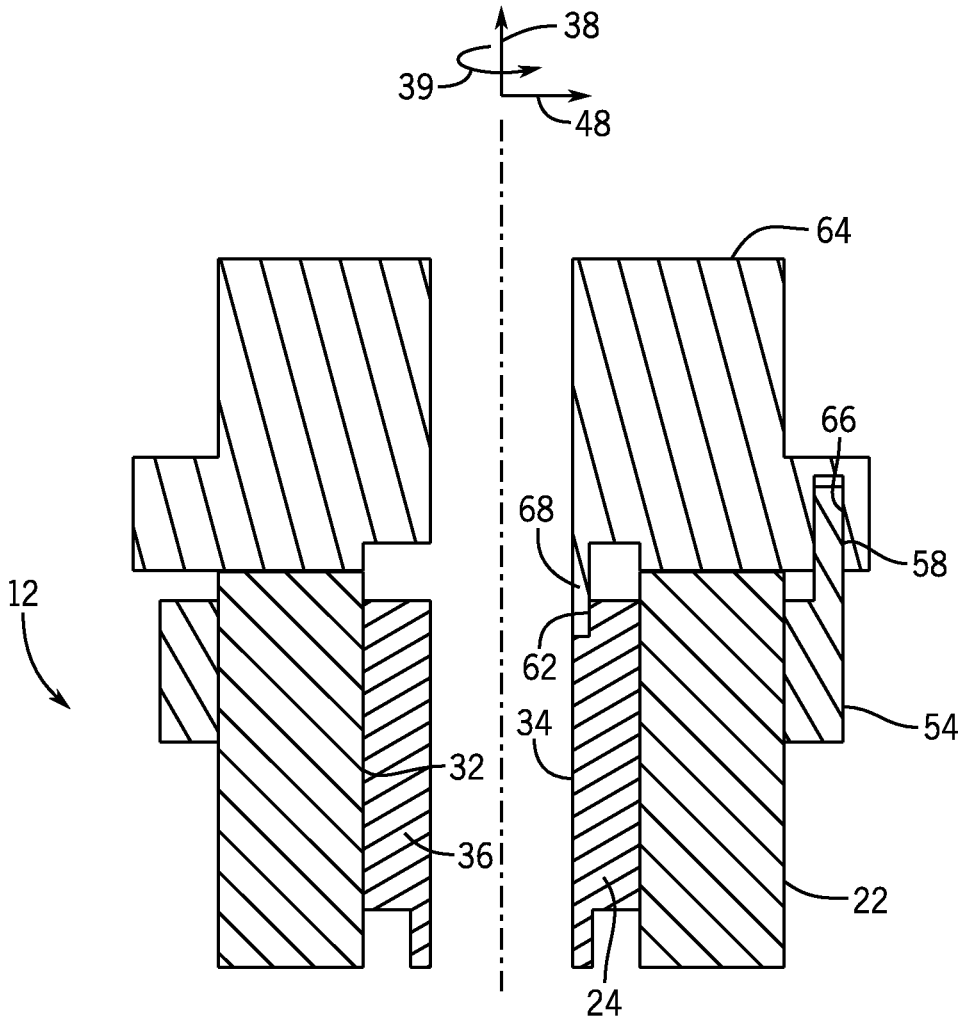
FIG. 7 is a cross-sectional view of the wellhead system of FIG. 6, in which the tree is disposed on the wellhead.

FIG. 7 is a cross-sectional view of the wellhead system 12 of FIG. 6, in which the tree 64 is disposed on the wellhead 22. As illustrated, the tree 64 is disposed on the wellhead 22 such that an alignment feature 68 (e.g., third alignment feature) of the tree 64 engages the corresponding alignment feature 62 of the tubing hanger 24. As a result of the engagement between the alignment feature 68 of the tree 64 and the corresponding alignment feature 62 of the tubing hanger 24, the target circumferential orientation of the tree 64 relative to the tubing hanger 24 is precisely established. Accordingly, the connectors of the tubing hanger 24 are precisely aligned with the connectors of the tree 64. As used herein, "precisely" oriented/aligned components are closer to the respective target than "approximately" oriented/aligned components. While the alignment feature 68 of the tree 64 is configured to engage the corresponding alignment feature 62 of the tubing hanger 24 in the illustrated embodiment, in other embodiments, the alignment feature of the tree may be configured to engage another suitable alignment feature of the tubing hanger.

Figure 8:
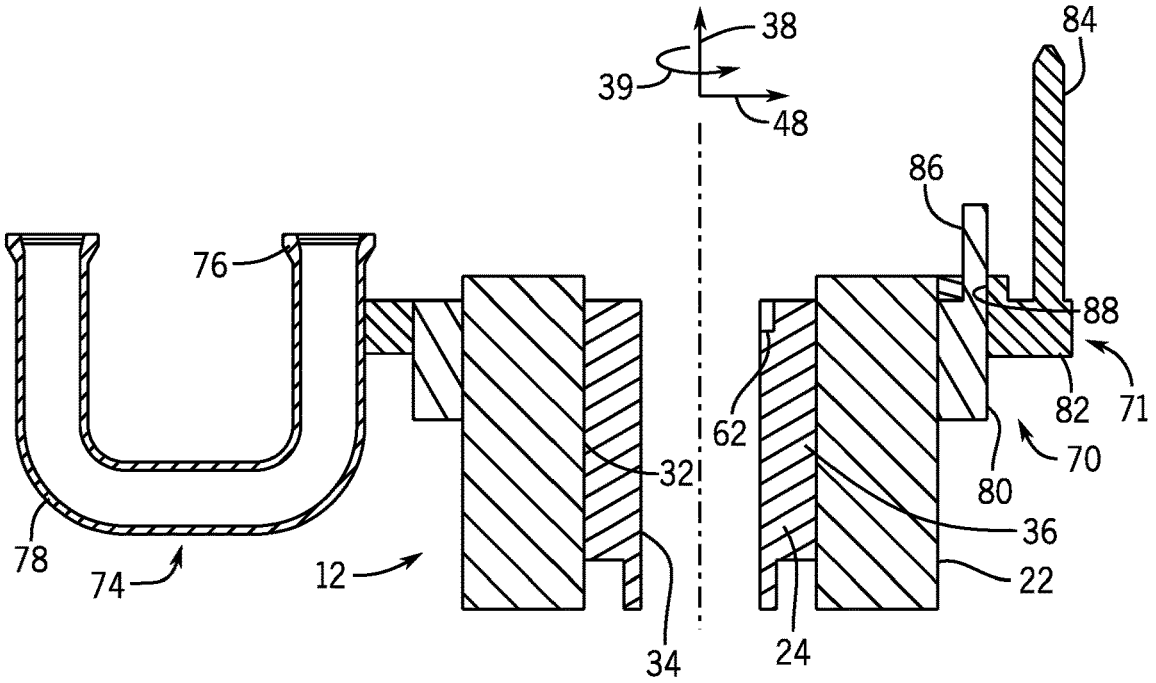
FIG. 8 is a cross-sectional view of the wellhead system of FIG. 5, in which another embodiment of an orientation mechanism is disposed on the wellhead.

FIG. 8 is a cross-sectional view of the wellhead system 12 of FIG. 5, in which another embodiment of an orientation mechanism 70 is disposed on the wellhead 22. The orientation mechanism 70 and the orientation mechanism running tool are elements of an orientation system 71. As previously discussed with reference to FIG. 4, after the BOP/riser system is removed from the wellhead 22, the orientation mechanism 70 may be disposed on the wellhead 22, as illustrated. In the illustrated embodiment, the orientation mechanism 70 includes a flowline positioning system 74 configured to position an inlet 76 of a flowline at a target circumferential position (e.g., target position along the circumferential axis 39) based on the target circumferential orientation (e.g., first target circumferential orientation) of the orientation mechanism 70. As discussed in detail below, with the inlet of the flowline at the target circumferential position and the tree precisely oriented at the target circumferential orientation (e.g., second target circumferential orientation), the inlet 76 of the flowline is precisely aligned with an outlet of the tree.

In the illustrated embodiment, the flowline positioning system 74 includes a u-loop 78. One end of the u-loop 78 forms the inlet 76 of the flowline, and the other end of the u-loop 78 is configured to couple to a conduit (e.g., hose, pipe, etc.) of the flowline. Accordingly, the u-loop 78 and the conduit collectively form the flowline. While the flowline positioning system 74 includes the u-loop 78 in the illustrated embodiment, in other embodiments, the flowline positioning system may include any other suitable device(s) configured to position the flowline inlet at the target circumferential position, such as a parking assembly that receives the flowline inlet and positions the flowline inlet at the target circumferential position. Furthermore, while the flowline positioning system is configured to orient the flowline inlet along the longitudinal axis in the illustrated embodiment, in other embodiments, the flowline positioning system may be configured to orient the flowline inlet along the radial axis to interface with an outlet of the tree extending along the radial axis.

In the illustrated embodiment, the orientation mechanism 70 includes an orientation device 80 and a flow base 82. The orientation device 80 may be coupled to the wellhead 22 in the same manner as the orientation mechanism disclosed above with reference to FIGS. 4-5 (e.g., lowered/run to the wellhead 22 along the longitudinal axis 38 using an orientation mechanism running tool). For example, in certain embodiments, the orientation device 80 may be the same as the orientation mechanism disclosed above with reference to FIGS. 4-5. The flow base 82 includes an alignment feature 84 (e.g., first alignment feature, second alignment feature) configured to engage a corresponding alignment feature (e.g., first corresponding alignment feature, second corresponding alignment feature) of the tree. The flow base 82 also includes the flowline positioning system 74. In addition, the orientation device 80 includes an alignment feature 86 (e.g., third alignment feature, fourth alignment feature) configured to engage a corresponding alignment feature 88 (e.g., third corresponding alignment feature, fourth corresponding alignment feature) of the flow base 82.

In certain embodiments, the orientation device 80 is lowered (e.g., run) to the wellhead 22 using an orientation mechanism running tool. In such embodiments, an alignment feature (e.g., first alignment feature, second alignment feature) of the orientation mechanism running tool may engage the corresponding alignment feature 62 (e.g., first corresponding alignment feature, second corresponding alignment feature) of the tubing hanger 24 as the orientation device 80 is disposed on the wellhead 22, thereby establishing a target circumferential orientation (e.g., first target circumferential orientation) of the orientation device 80 relative to the tubing hanger 24. The orientation mechanism running tool may be circumferentially non-rotatably coupled to the orientation device 80 via the alignment feature 86 to establish a desired circumferential offset (e.g., 0 degrees, 10 degrees, 20 degrees, etc.) between the alignment feature 86 of the orientation device 80 and the alignment feature of the orientation mechanism running tool. Accordingly, engaging the alignment feature of the orientation mechanism running tool with the corresponding alignment feature 62 of the tubing hanger 24 positions (e.g., precisely positions) the alignment feature 86 of the orientation device 80 at a target circumferential position (e.g., position along the circumferential axis 39). As a result, a desired offset between the corresponding alignment feature 62 of the tubing hanger 24 and the alignment feature 86 of the orientation device 80 is established.

To engage the alignment feature of the orientation mechanism running tool with the corresponding alignment feature 62 of the tubing hanger 24, the orientation mechanism running tool may be rotated along the circumferential axis 39 until the alignment feature of the orientation mechanism running tool engages the corresponding alignment feature 62 of the tubing hanger 24 (e.g., in response to circumferential alignment of the alignment features). In certain embodiments, a bearing may be disposed between the orientation mechanism running tool and the wellhead (e.g., coupled to the orientation mechanism running tool) to facilitate rotation of the orientation mechanism running tool along the circumferential axis relative to the wellhead. In certain embodiments, the alignment feature of the orientation mechanism running tool includes a longitudinal protrusion, and the corresponding alignment feature 62 of the tubing hanger 24 includes a corresponding longitudinal recess. However, in other embodiments, the alignment feature of the orientation mechanism running tool and the corresponding alignment feature of the tubing hanger may include other suitable type(s) of alignment feature(s). For example, in certain embodiments, the alignment feature of the orientation mechanism running tool may include one or more recesses, and the corresponding alignment feature of the tubing hanger may include corresponding protrusion(s). Furthermore, in certain embodiments, the alignment feature of the orientation mechanism running tool may include one or more radial pins, and the corresponding alignment feature of the tubing hanger may include corresponding radial groove(s) (e.g., within a longitudinal end of the tubing hanger) configured to receive the radial pin(s). Once the alignment feature of the orientation mechanism running tool is engaged with the corresponding alignment feature of the tubing hanger, rotation of the orientation device relative to the tubing hanger along the circumferential axis is blocked.

The orientation device 80 is circumferentially non-rotatably coupled to the wellhead 22 (e.g., as the orientation device is being disposed on the wellhead or after the orientation device is disposed on the wellhead). For example, in certain embodiments, the orientation device may include one or more protrusions (e.g., retractable protrusion(s)) configured to engage corresponding recess(es) of the wellhead to block rotation of the orientation device relative to the wellhead along the circumferential axis. Additionally or alternatively, the orientation device may include one or more recesses configured to engage corresponding protrusion(s) (e.g., retractable protrusion(s)) of the wellhead. Furthermore, in certain embodiments, a locking ring (e.g., disposed about the orientation device) may circumferentially non-rotatably couple the orientation device to the wellhead (e.g., alone or in combination with the recess(es)/protrusion(s)). While recess(es)/protrusion(s) and a locking ring are disclosed above, other suitable type(s) of locking device(s) may be used (e.g., alone or in combination with the recess(es)/protrusion(s) and/or the locking ring) to circumferentially non-rotatably couple the orientation device to the wellhead. In addition, in certain embodiments, one or more radial pads may be disposed between the orientation device and the wellhead. Furthermore, any suitable device(s) may be utilized to block movement of the orientation device 80 relative to the wellhead 22 along the longitudinal axis 38 (e.g., one or more protrusions configured to engage corresponding recess(es), one or more engagement surfaces, etc.).

Once the orientation device 80 is coupled to the wellhead 22, the orientation mechanism running tool may be removed. The flow base 82 may then be disposed on the orientation device 80 such that the alignment feature 86 of the orientation device 80 engages the corresponding alignment feature 88 of the flow base 82, thereby establishing a target circumferential orientation (e.g., first target circumferential orientation) of the flow base 82 relative to the tubing hanger 24. In certain embodiments, the flow base 82 is lowered (e.g., run) to the wellhead 22 along the longitudinal axis 38 using a suitable running tool. For example, the landing string may be coupled to the flow base running tool and used to lower (e.g., run) the flow base to the wellhead 22. While the flow base 82 is disposed on the orientation device 80 in the illustrated embodiment, in other embodiments, the flow base may be disposed on the wellhead (e.g., alone or in combination with the orientation device).

With the alignment feature 86 of the orientation device 80 engaged with the corresponding alignment feature 88 of the flow base 82, the flow base 82 is circumferentially non-rotatably coupled to the orientation device 80. In addition, the flow base 82 is oriented at the target circumferential orientation relative to the tubing hanger 24. Accordingly, the alignment feature 84 of the flow base 82 is positioned (e.g., precisely positioned) at a target circumferential position (e.g., position along the circumferential axis 39). As a result, a desired offset between the corresponding alignment feature 62 of the tubing hanger 24 and the alignment feature 84 of the flow base 82 is established. Once the flow base 82 is landed on the orientation device/wellhead, the flow base running tool may be removed. While the orientation device includes one orientation feature for both the orientation mechanism running tool and the flow base in the illustrated embodiment, in other embodiments, the orientation device may include one orientation feature for the orientation mechanism running tool and another orientation feature for the flow base. Furthermore, while the orientation device and the flow base are landed via two separate lowering (e.g., running) operations in the present embodiment, in other embodiments, the orientation device and the flow base may be coupled to one another and then lowered (e.g., run) via a single lowering (e.g., running operation).

As previously discussed with regard to the embodiment of FIGS. 4-7, the tree may be moved toward the wellhead 22 such that the alignment feature 84 of the flow base 82 engages the corresponding alignment feature (e.g., first corresponding alignment feature, second corresponding alignment feature) of the tree, thereby approximately establishing a target circumferential orientation (e.g., second target circumferential orientation) of the tree relative to the tubing hanger 24. As previously discussed, a desired circumferential offset between the corresponding alignment feature 62 of the tubing hanger 24 and the alignment feature 86 of the orientation device 80 is established using the orientation mechanism running tool, and a desired circumferential offset between the alignment feature 84 of the flow base 82 and the alignment feature 86 of the orientation device 80 is established using the orientation device 80. Accordingly, engaging the alignment feature 84 of the flow base 82 with the corresponding alignment feature of the tree approximately establishes a target circumferential orientation of the tree relative to the tubing hanger 24.

In the illustrated embodiment, the alignment feature 84 of the flow base 82 includes a longitudinal protrusion, and the corresponding alignment feature of the tree includes a corresponding longitudinal recess. In certain embodiments, the circumferential extent of the longitudinal recess is greater than the circumferential extent of the longitudinal protrusion. Accordingly, an amount of circumferential rotation of the tree relative to the orientation mechanism, wellhead, and tubing hanger is enabled. While the alignment feature of the flow base includes a longitudinal protrusion and the corresponding alignment feature of the tree includes a corresponding longitudinal recess in the illustrated embodiment, in other embodiments, the alignment feature of the flow base and the corresponding alignment feature of the tree may include other suitable type(s) of alignment feature(s). For example, in certain embodiments, the alignment feature of the flow base may include one or more recesses, and the corresponding alignment feature of the tree may include corresponding protrusion(s). Furthermore, in certain embodiments, the alignment feature of the flow base may include one or more radial pins, and the corresponding alignment feature of the tree may include corresponding radial groove(s) (e.g., within a longitudinal end of the tree) configured to receive the radial pin(s). In addition, while the alignment feature of the flow base is configured to engage the corresponding alignment feature of the tree in the illustrated embodiment, in other embodiments, an alignment feature of the orientation device may be configured to engage the corresponding alignment feature of the tree (e.g., the alignment feature of the flow base may be omitted). For example, the alignment feature of the orientation device configured to engage the corresponding alignment feature of the flow base may also be configured to engage the corresponding alignment feature of the tree.

The tree may be disposed on the wellhead 22 such that the alignment feature (e.g., third alignment feature) of the tree engages the corresponding alignment feature 62 of the tubing hanger 24. As a result of the engagement between the alignment feature of the tree and the corresponding alignment feature 62 of the tubing hanger 24, the target circumferential orientation of the tree relative to the tubing hanger 24 is precisely established. Accordingly, the connectors of the tubing hanger 24 are precisely aligned with the connectors of the tree. In addition, with the tree precisely oriented at the target circumferential orientation, the outlet of the tree is precisely positioned at the target circumferential position, thereby precisely circumferentially aligning the outlet of the tree with the inlet 76 of the flowline. Due to the precise circumferential alignment between the inlet 76 of the flowline and the outlet of the tree, the inlet 76 of the flowline may be coupled to the outlet of the tree (e.g., via any suitable connection system, such as a clamped connection, etc.). As used herein, "precisely" oriented/aligned components are closer to the respective target than "approximately" oriented/aligned components. While the alignment feature of the tree is configured to engage the corresponding alignment feature 62 of the tubing hanger 24 in the illustrated embodiment, in other embodiments, the alignment feature of the tree may be configured to engage another suitable alignment feature of the tubing hanger.

Figure 9:
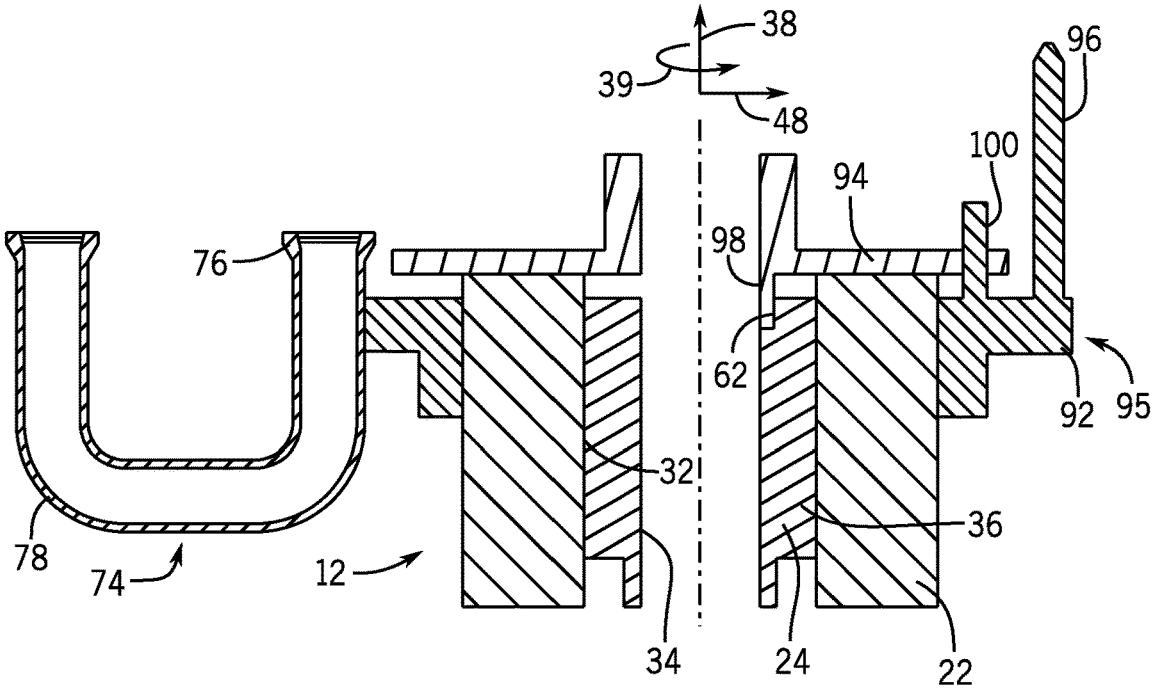
FIG. 9 is a cross-sectional view of the wellhead system of FIG. 3, in which the blowout preventer is removed from the wellhead, an embodiment of an orientation mechanism is disposed on the wellhead, and an embodiment of an orientation mechanism running tool is coupled to the orientation mechanism.

FIG. 9 is a cross-sectional view of the wellhead system 12 of FIG. 3, in which the blowout preventer is removed from the wellhead 22, an embodiment of an orientation mechanism 92 is disposed on the wellhead 22, and an embodiment of an orientation mechanism running tool 94 is coupled to the orientation mechanism 92. The orientation mechanism 92 and the orientation mechanism running tool 94 are elements of an orientation system 95. After the BOP/riser system is removed from the wellhead 22, the orientation mechanism 92 may be disposed on the wellhead 22, as illustrated. For example, in certain embodiments, the orientation mechanism 92 may include a single element (e.g., as compared to the orientation mechanism disclosed above with reference to FIG. 8 that includes two elements, i.e., the orientation device and the flow base) disposed on the wellhead 22 via a single operation (e.g., as compared to the two operations for disposing the orientation mechanism on the wellhead disclosed above with reference to FIG. 8, i.e., disposing the orientation device on the wellhead and disposing the flow base on the orientation device/wellhead). In the illustrated embodiment, the orientation mechanism 92 is lowered (e.g., run) to the wellhead 22 along the longitudinal axis 38 using the orientation mechanism running tool 94. The orientation mechanism running tool 94 is non-rotatably coupled to the orientation mechanism 92 and supports the orientation mechanism 92 during the lowering (e.g., running) process. For example, the landing string may be coupled to the orientation mechanism running tool 94 and used to lower (e.g., run) the orientation mechanism 92 to the wellhead 22.

In the illustrated embodiment, the orientation mechanism 92 includes a flowline positioning system 74 configured to position an inlet 76 of a flowline at a target circumferential position (e.g., target position along the circumferential axis 39) based on the target circumferential orientation (e.g., first target circumferential orientation) of the orientation mechanism 92. As discussed in detail below, with the inlet of the flowline at the target circumferential position and the tree precisely oriented at the target circumferential orientation (e.g., second target circumferential orientation), the inlet 76 of the flowline is precisely aligned with an outlet of the tree. In the illustrated embodiment, the flowline positioning system 74 includes a u-loop 78. One end of the u-loop 78 forms the inlet 76 of the flowline, and the other end of the u-loop 78 is configured to couple to a conduit (e.g., hose, pipe, etc.) of the flowline. Accordingly, the u-loop 78 and the conduit collectively form the flowline. While the flowline positioning system 74 includes the u-loop 78 in the illustrated embodiment, in other embodiments, the flowline positioning system may include any other suitable device(s) configured to position the flowline inlet at the target circumferential position, such as a parking assembly that receives the flowline inlet and positions the flowline inlet at the target circumferential position. Furthermore, while the flowline positioning system is configured to orient the flowline inlet along the longitudinal axis in the illustrated embodiment, in other embodiments, the flowline positioning system may be configured to orient the flowline inlet along the radial axis to interface with an outlet of the tree extending along the radial axis.

In the illustrated embodiment, the orientation mechanism 92 includes an alignment feature 96 (e.g., first alignment feature, second alignment feature) configured to engage a corresponding alignment feature (e.g., first corresponding alignment feature, second corresponding alignment feature) of the tree. In addition, an alignment feature 98 (e.g., first alignment feature, second alignment feature) of the orientation mechanism running tool 94 engages the corresponding alignment feature 62 (e.g., first corresponding alignment feature, second corresponding alignment feature) of the tubing hanger 24 as the orientation mechanism 92 is disposed on the wellhead 22, thereby establishing a target circumferential orientation (e.g., first target circumferential orientation) of the orientation mechanism 92 relative to the tubing hanger 24. The orientation mechanism running tool 94 is circumferentially non-rotatably coupled to the orientation mechanism 92 via another alignment feature 100 of the orientation mechanism 92 to establish a desired circumferential offset (e.g., 0 degrees, 10 degrees, 20 degrees, etc.) between the alignment feature 96 of the orientation mechanism 92 and the alignment feature 98 of the orientation mechanism running tool 94. Accordingly, engaging the alignment feature 98 of the orientation mechanism running tool 94 with the corresponding alignment feature 62 of the tubing hanger 24 positions (e.g., precisely positions) the alignment feature 96 of the orientation mechanism 92 at a target circumferential position (e.g., position along the circumferential axis 39). As a result, a desired offset between the corresponding alignment feature 62 of the tubing hanger 24 and the alignment feature 96 of the orientation mechanism 92 is established.

To engage the alignment feature 98 of the orientation mechanism running tool 94 with the corresponding alignment feature 62 of the tubing hanger 24, the orientation mechanism running tool 94 may be rotated along the circumferential axis 39 until the alignment feature 98 of the orientation mechanism running tool 94 engages the corresponding alignment feature 62 of the tubing hanger 24 (e.g., in response to circumferential alignment of the alignment features). In certain embodiments, a bearing may be disposed between the orientation mechanism running tool and the wellhead (e.g., coupled to the orientation mechanism running tool) to facilitate rotation of the orientation mechanism running tool along the circumferential axis relative to the wellhead. In the illustrated embodiment, the alignment feature 98 of the orientation mechanism running tool 94 includes a longitudinal protrusion, and the corresponding alignment feature 62 of the tubing hanger 24 includes a corresponding longitudinal recess. However, in other embodiments, the alignment feature of the orientation mechanism running tool and the corresponding alignment feature of the tubing hanger may include other suitable type(s) of alignment feature(s). For example, in certain embodiments, the alignment feature of the orientation mechanism running tool may include one or more recesses, and the corresponding alignment feature of the tubing hanger may include corresponding protrusion(s). Furthermore, in certain embodiments, the alignment feature of the orientation mechanism running tool may include one or more radial pins, and the corresponding alignment feature of the tubing hanger may include corresponding radial groove(s) (e.g., within a longitudinal end of the tubing hanger) configured to receive the radial pin(s). Once the alignment feature of the orientation mechanism running tool is engaged with the corresponding alignment feature of the tubing hanger, rotation of the orientation mechanism relative to the tubing hanger along the circumferential axis is blocked.

The orientation mechanism 92 is circumferentially non-rotatably coupled to the wellhead 22 (e.g., as the orientation mechanism is being disposed on the wellhead or after the orientation mechanism is disposed on the wellhead). For example, in certain embodiments, the orientation mechanism may include one or more protrusions (e.g., retractable protrusion(s)) configured to engage corresponding recess(es) of the wellhead to block rotation of the orientation mechanism relative to the wellhead along the circumferential axis. Additionally or alternatively, the orientation mechanism may include one or more recesses configured to engage corresponding protrusion(s) (e.g., retractable protrusion(s)) of the wellhead. Furthermore, in certain embodiments, a locking ring (e.g., disposed about the orientation mechanism) may circumferentially non-rotatably couple the orientation mechanism to the wellhead (e.g., alone or in combination with the recess(es)/protrusion(s)). While recess(es)/protrusion(s) and a locking ring are disclosed above, other suitable type(s) of locking device(s) may be used (e.g., alone or in combination with the recess(es)/protrusion(s) and/or the locking ring) to circumferentially non-rotatably couple the orientation mechanism to the wellhead. In addition, in certain embodiments, one or more radial pads may be disposed between the orientation mechanism and the wellhead. Furthermore, any suitable device(s) may be utilized to block movement of the orientation mechanism 92 relative to the wellhead 22 along the longitudinal axis 38 (e.g., one or more protrusions configured to engage corresponding recess(es), one or more engagement surfaces, etc.).

Once the orientation mechanism 92 is coupled to the wellhead 22, the orientation mechanism running tool 94 is removed. As previously discussed with regard to the embodiment of FIGS. 4-7, the tree may then be moved toward the wellhead 22 such that the alignment feature 96 of the orientation mechanism 92 engages the corresponding alignment feature (e.g., first corresponding alignment feature, second corresponding alignment feature) of the tree, thereby approximately establishing a target circumferential orientation (e.g., second target circumferential orientation) of the tree relative to the tubing hanger 24. As previously discussed, a desired circumferential offset between the corresponding alignment feature 62 of the tubing hanger 24 and the alignment feature 96 of the orientation mechanism 92 is established using the orientation mechanism running tool 94. Accordingly, engaging the alignment feature 96 of the orientation mechanism 92 with the corresponding alignment feature of the tree approximately establishes a target circumferential orientation of the tree relative to the tubing hanger 24.

In the illustrated embodiment, the alignment feature 96 of the orientation mechanism 92 includes a longitudinal protrusion, and the corresponding alignment feature of the tree includes a corresponding longitudinal recess. In certain embodiments, the circumferential extent of the longitudinal recess is greater than the circumferential extent of the longitudinal protrusion. Accordingly, an amount of circumferential rotation of the tree relative to the orientation mechanism, wellhead, and tubing hanger is enabled. While the alignment feature of the orientation mechanism includes a longitudinal protrusion and the corresponding alignment feature of the tree includes a corresponding longitudinal recess in the illustrated embodiment, in other embodiments, the alignment feature of the orientation mechanism and the corresponding alignment feature of the tree may include other suitable type(s) of alignment feature(s). For example, in certain embodiments, the alignment feature of the orientation mechanism may include one or more recesses, and the corresponding alignment feature of the tree may include corresponding protrusion(s). Furthermore, in certain embodiments, the alignment feature of the orientation mechanism may include one or more radial pins, and the corresponding alignment feature of the tree may include corresponding radial groove(s) (e.g., within a longitudinal end of the tree) configured to receive the radial pin(s). In addition, while the orientation mechanism 92 includes one alignment feature 96 configured to engage the corresponding alignment feature of the tree and another alignment feature 100 configured to engage the orientation mechanism running tool 94 in the illustrated embodiment, in other embodiments, the orientation mechanism may include a single alignment feature configured to engage the corresponding alignment feature of the tree and the orientation mechanism running tool.

The tree may then be disposed on the wellhead 22 such that the alignment feature (e.g., third alignment feature) of the tree engages the corresponding alignment feature 62 of the tubing hanger 24. As a result of the engagement between the alignment feature of the tree and the corresponding alignment feature 62 of the tubing hanger 24, the target circumferential position of the tree relative to the tubing hanger 24 is precisely established. Accordingly, the connectors of the tubing hanger 24 are precisely aligned with the connectors of the tree. In addition, with the tree precisely oriented at the target circumferential orientation, the outlet of the tree is precisely positioned at the target circumferential position, thereby precisely circumferentially aligning the outlet of the tree with the inlet 76 of the flowline. Due to the precise circumferential alignment between the inlet 76 of the flowline and the outlet of the tree, the inlet 76 of the flowline may be coupled to the outlet of the tree (e.g., via any suitable connection system, such as a clamped connection, etc.). As used herein, "precisely" oriented/aligned components are closer to the respective target than "approximately" oriented/aligned components. While the alignment feature of the tree is configured to engage the corresponding alignment feature 62 of the tubing hanger 24 in the illustrated embodiment, in other embodiments, the alignment feature of the tree may be configured to engage another suitable alignment feature of the tubing hanger.

Technical effects of the disclosure include substantially reducing the cost of a wellhead system of a resource extraction system. In certain embodiments, a riser system is disposed on a wellhead without utilizing a mechanical alignment system to circumferentially align the riser system with the wellhead. As a result, the cost of the wellhead system may be substantially reduced (e.g., as compared to a riser system that includes a mechanical alignment feature that is precisely calibrated for the wellhead during the manufacturing process). In addition, a tubing hanger may then be disposed at a landed position within the wellhead. Furthermore, an orientation mechanism may be disposed on the wellhead. The orientation mechanism includes a first alignment feature configured to engage a first corresponding alignment feature of the tree. In addition, a second alignment feature of an orientation mechanism running tool engages a second corresponding alignment feature of the tubing hanger as the orientation mechanism is disposed on the wellhead to establish a first target circumferential orientation of the orientation mechanism relative to the tubing hanger. Next, the tree may be moved toward the wellhead such that the first corresponding alignment feature of the tree engages the first alignment feature of the orientation mechanism to approximately establish a second target circumferential orientation of the tree relative to the tubing hanger. The tree may then be disposed on the wellhead such that a third alignment feature of the tree engages the second corresponding alignment feature of the tubing hanger to precisely establish the second target circumferential orientation of the tree relative to the tubing hanger. Because the first target circumferential orientation of the orientation mechanism and the second target circumferential orientation of the tree are based on the circumferential orientation of the tubing hanger, the second target circumferential orientation of the tree relative to the tubing hanger may be precisely established without regard to the circumferential orientation of the tubing hanger relative to the wellhead. In embodiments in which the riser system is disposed on the wellhead without utilizing a mechanical alignment system to circumferentially align the riser system with the wellhead, the cost of the wellhead system may be substantially reduced (e.g., as compared to a riser system that includes a mechanical alignment system). In addition, in certain embodiments, the orientation mechanism includes a flowline positioning system configured to position an inlet of a flowline at a target circumferential position based on the first target circumferential orientation of the orientation mechanism. In such embodiments, an outlet of the tree is positioned precisely at the target circumferential position while the tree is precisely oriented at the second target circumferential orientation, such that the outlet of the tree is precisely circumferentially aligned with the inlet of the flowline. Because the circumferential alignment of the outlet of the tree and the inlet of the flowline is based on the circumferential positioning of the alignment features of the orientation mechanism relative to the corresponding alignment feature of the tubing hanger, the circumferential alignment of the outlet of the tree and the inlet of the flowline may be more precise than a circumferential alignment established using a greater number of interfaces. In addition, because the orientation mechanism enables the flowline positioning system to be lowered (e.g., run) after the tubing hanger, the orientation mechanism/flowline positioning system may be re-lowered (e.g., re-run) if the outlet of the tree is not precisely circumferentially aligned with the inlet of the flowline (e.g., as compared to a configuration in which the tubing hanger is run after the flowline positioning system, and the tubing hanger is re-lowered/re-run if the outlet of the tree is not precisely circumferentially aligned with the inlet of the flowline). As a result, the cost associated with the re-lowering (e.g., re-running) process may be substantially reduced (e.g., as compared to the process of re-lowering/re-running the tubing hanger).

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A method for aligning a tree within a resource extraction system, comprising:

disposing a riser system on a wellhead of the resource extraction system without utilizing a mechanical alignment system to circumferentially align the riser system with the wellhead;

disposing a tubing hanger at a landed position within the wellhead;

removing the riser system from the wellhead;

disposing an orientation mechanism on the wellhead, wherein the orientation mechanism comprises a first alignment feature configured to engage a first corresponding alignment feature of the tree, and a second alignment feature of an orientation mechanism running tool engages a second corresponding alignment feature of the tubing hanger as the orientation mechanism is disposed on the wellhead to establish a first target circumferential orientation of the orientation mechanism relative to the tubing hanger;

moving the tree toward the wellhead such that the first corresponding alignment feature of the tree engages the first alignment feature of the orientation mechanism to approximately establish a second target circumferential orientation of the tree relative to the tubing hanger; and disposing the tree on the wellhead such that a third alignment feature of the tree engages the second corresponding alignment feature of the tubing hanger to precisely establish the second target circumferential orientation of the tree relative to the tubing hanger.

2. The method of claim 1, wherein disposing the orientation mechanism on the wellhead comprises:

moving the orientation mechanism toward the wellhead using the orientation mechanism running tool;

utilizing the second alignment feature of the orientation mechanism running tool to establish the first target circumferential orientation of the orientation mechanism relative to the tubing hanger; and removing the orientation mechanism running tool.

3. The method of claim 1, wherein the riser system comprises a blowout preventer.

4. The method of claim 1, wherein disposing the tubing hanger at the landed position within the wellhead comprises driving, via an alignment assembly, the tubing hanger to rotate to a third target circumferential orientation relative to the riser system.

5. The method of claim 4, wherein the alignment assembly comprises:

a protrusion movably coupled to the riser system; and a cam surface formed on a tubing hanger running tool, wherein the tubing hanger running tool is coupled to the tubing hanger while the tubing hanger is moved to the landed position within the wellhead.

6. The method of claim 1, wherein disposing the riser system on the wellhead comprises utilizing visual alignment, an optical alignment system, or a combination thereof, to circumferentially align the riser system with the wellhead.

7. A method for aligning a tree within a resource extraction system, comprising:

disposing a riser system on a wellhead of the resource extraction system;

disposing a tubing hanger at a landed position within the wellhead;

removing the riser system from the wellhead;

disposing an orientation mechanism on the wellhead, wherein the orientation mechanism comprises a first alignment feature configured to engage a first corresponding alignment feature of the tree, a second alignment feature of an orientation mechanism running tool engages a second corresponding alignment feature of the tubing hanger as the orientation mechanism is disposed on the wellhead to establish a first target circumferential orientation of the orientation mechanism relative to the tubing hanger, and the orientation mechanism comprises a flowline positioning system configured to position an inlet of a flowline at a target circumferential position based on the first target circumferential orientation of the orientation mechanism;

moving the tree toward the wellhead such that the first corresponding alignment feature of the tree engages the first alignment feature of the orientation mechanism to approximately establish a second target circumferential orientation of the tree relative to the tubing hanger; and disposing the tree on the wellhead such that a third alignment feature of the tree engages the second corresponding alignment feature of the tubing hanger to precisely establish the second target circumferential orientation of the tree relative to the tubing hanger, wherein an outlet of the tree is positioned precisely at the target circumferential position while the tree is precisely oriented at the second target circumferential orientation such that the outlet of the tree is precisely circumferentially aligned with the inlet of the flowline.

8. The method of claim 7, wherein the riser system is disposed on the wellhead without utilizing a mechanical alignment system to circumferentially align the riser system with the wellhead.

9. The method of claim 8, wherein disposing the riser system on the wellhead comprises utilizing visual alignment, an optical alignment system, or a combination thereof, to circumferentially align the riser system with the wellhead.

10. The method of claim 7, wherein the orientation mechanism comprises a single element disposed on the wellhead via a single operation.

11. The method of claim 10, wherein disposing the orientation mechanism on the wellhead comprises:

moving the orientation mechanism toward the wellhead using the orientation mechanism running tool;

utilizing the second alignment feature of the orientation mechanism running tool to establish the first target circumferential orientation of the orientation mechanism relative to the tubing hanger; and removing the orientation mechanism running tool.

12. The method of claim 7, wherein the orientation mechanism comprises an orientation device and a flow base, the flow base comprises the first alignment feature and the flowline positioning system, and disposing the orientation mechanism on the wellhead comprises:

disposing the orientation device on the wellhead, wherein the orientation device comprises a fourth alignment feature configured to engage a fourth corresponding alignment feature of the flow base, and the second alignment feature of the orientation mechanism running tool engages the second corresponding alignment feature of the tubing hanger as the orientation device is disposed on the wellhead to establish the first target circumferential orientation of the orientation device relative to the tubing hanger; and disposing the flow base on the orientation device such that the fourth alignment feature of the orientation device engages the fourth corresponding alignment feature of the flow base to establish the first target circumferential orientation of the flow base relative to the tubing hanger.

13. The method of claim 12, wherein disposing the orientation device on the wellhead comprises:

moving the orientation device toward the wellhead using the orientation mechanism running tool;

utilizing the second alignment feature of the orientation mechanism running tool to establish the first target circumferential orientation of the orientation device relative to the tubing hanger; and removing the orientation mechanism running tool.

14. The method of claim 7, wherein the riser system comprises a blowout preventer.

15. The method of claim 7, wherein disposing the tubing hanger at the landed position within the wellhead comprises driving, via an alignment assembly, the tubing hanger to rotate to a third target circumferential orientation relative to the riser system.

16. The method of claim 15, wherein the alignment assembly comprises:

a protrusion movably coupled to the riser system; and a cam surface formed on a tubing hanger running tool, wherein the tubing hanger running tool is coupled to the tubing hanger while the tubing hanger is moved to the landed position within the wellhead.

17. An orientation system for a tree of a resource extraction system, comprising an orientation mechanism and an orientation mechanism running tool, wherein the orientation mechanism running tool is configured to move the orientation mechanism toward a wellhead of the resource extraction system;

the orientation mechanism running tool comprises a first alignment feature configured to engage a first corresponding alignment feature of a tubing hanger within the wellhead to establish a first target circumferential orientation of the orientation mechanism relative to the tubing hanger;

the orientation mechanism comprises a second alignment feature configured to engage a second corresponding alignment feature of the tree as the tree moves toward the wellhead to approximately establish a second target circumferential orientation of the tree relative to the tubing hanger; and the orientation mechanism comprises a flowline positioning system configured to position an inlet of a flowline at a target circumferential position based on the first target circumferential orientation to precisely align the inlet of the flowline with an outlet of the tree while the tree is precisely oriented at the second target circumferential orientation.

18. The orientation system of claim 17, wherein the orientation mechanism comprises a single element configured to be disposed on the wellhead via a single operation.

19. The orientation system of claim 17, wherein the orientation mechanism comprises an orientation device and a flow base, the flow base comprises the second alignment feature and the flowline positioning system, and the orientation device comprises a third alignment feature configured to engage a third corresponding alignment feature of the flow base to establish the first target circumferential orientation of the flow base relative to the tubing hanger.

20. The orientation system of claim 17, wherein the flowline positioning system comprises a u-loop, and one end of the u-loop forms the inlet of the flowline.

* * * * *